US005857242A

United States Patent [19]

Pizzo et al.

[11] Patent Number: 5,857,242

[45] Date of Patent: Jan. 12, 1999

[54] CONTROL KNOB

[75] Inventors: William C. Pizzo, Lombard, Ill.; James E. Sippel, Huber Heights, Ohio; Michael J. Hall, Manhattan, Ill.

[73] Assignee: Illinois Tool Works Inc., Glenview, Ill.

[21] Appl. No.: 746,989

[22] Filed: Nov. 19, 1996

[51] Int. Cl.[6] ..... A47B 95/02

[52] U.S. Cl. ..... 16/121

[58] Field of Search ..... 16/121, 114 R, 16/DIG. 40, DIG. 41; 74/553

[56] References Cited

U.S. PATENT DOCUMENTS

| | | | |
|---|---|---|---|
| 2,574,330 | 11/1951 | Judd | 16/121 |
| 3,188,124 | 6/1965 | Pestka et al. | 16/121 |
| 3,783,708 | 1/1974 | Witkowski | 74/553 |
| 3,808,635 | 5/1974 | Moran et al. | 16/121 |
| 3,880,536 | 4/1975 | Petrus | 16/121 |
| 3,994,608 | 11/1976 | Swiderski et al. | 74/553 |
| 4,179,771 | 12/1979 | Rankins et al. | 16/121 |
| 4,295,246 | 10/1981 | Howie, Jr. | 16/121 |
| 4,441,230 | 4/1984 | Howie, Jr. | 16/121 |
| 4,923,325 | 5/1990 | Howie, Jr. | 16/121 |

FOREIGN PATENT DOCUMENTS

| | | | |
|---|---|---|---|
| 3634858 | 4/1988 | Germany | 74/553 |

*Primary Examiner*—Chuck Mah

*Attorney, Agent, or Firm*—Kane,Dalsimer,Sullivan, Kurucz, Levy, Eisele and Richard, LLP

[57] ABSTRACT

The control knob includes an aperture with a D-shaped cross section. The aperture is formed by a relatively rigid planar portion and an arcuate portion which further includes a relatively flexible inner concentric portion and a relatively rigid flexible outer concentric portion. The relatively flexible inner concentric portion is attached to the relatively rigid planar portion by living hinges and further includes outwardly pointing stop bumps. The outwardly pointing stop bumps are spaced from said relatively rigid flexible outer concentric portion when no rotational torque is applied to the control knob with respect to the shaft and the structure allows torsional elasticity when a limited amount of rotational torque is applied to the control knob. However, when torque is applied which exceeds a threshold, the stop bumps are urged against the relatively flexible inner concentric portion and additional torsional elasticity and additional rotation is limited. The relatively rigid planar portion further includes a stop bump along a portion thereof which limits insertion of the shaft, but which collapses upon sudden impact to allow additional insertion of the shaft into the control knob.

8 Claims, 2 Drawing Sheets

CONTROL KNOB

BACKGROUND OF THE INVENTION

1. Field of the Invention

This invention pertains to a control knob for automobiles and similar applications. More particularly, the invention pertains to a control knob which is free of separate metallic springs engaging the shaft to which the knob is connected.

2. Description of the Prior Art

In the prior art, it is well known for a control knob for an automobile and similar applications to use a separate metallic spring which engaged the shaft to which the knob is attached. This allows for some torsional elasticity between the knob and the shaft, but returns the knob to a "home position" after the rotational force is removed. However, this use of a spring has led to an additional complexity and expense which is considerable in view of the high number of such control knobs which may be provided to an industry such as the automobile industry.

Similarly, it is important to limit the rotation of the knob with respect to the shaft.

Additionally, it is important to locate the control knob axially with respect to the shaft and, for safety concerns, it is important that the knob collapse and travel further down the shaft upon sudden impact (i.e., homoligation).

OBJECTS AND SUMMARY OF THE INVENTION

It is therefore an object of this invention to provide a control knob which has torsional elasticity with respect to the shaft to which it is attached, and which returns to its "home position" after the rotational force is removed.

It is therefore a further object of this invention to provide a control knob which has limited rotation about the shaft to which it is attached.

It is therefore a still further object of this invention to provide a control knob which is free of a separate metallic spring which engages the shaft to which the control knob is attached.

It is therefore a still further object of this invention to provide a control knob which locates itself axially upon the shaft to which it is attached.

It is therefore a final object of this invention to provide a control knob which collapses and travels further down the shaft upon sudden impact (i.e., homoligation).

These and other objects are attained by providing a one-piece plastic molded control knob which includes an aperture on its rear face for receiving the control knob. The aperture has a D-shaped cross section for receiving a metallic shaft with a circumference which includes a planar portion and an arcuate portion. The D-shape is formed by a flat or planar portion and an arcuate portion. The flat or planar portion includes an internal stop rib parallel with the longitudinal axis of the shaft. The stop rib extends from a relatively central axial internal location in the aperture to a forward location. Therefore, the shaft (which includes a cross section with a planar portion and an arcuate portion, the arcuate portion typically being substantially greater than 180° of the circumference, typically approaching 270°) can be inserted into the aperture with the planar portion of the shaft aligning with the planar portion of the D-shaped aperture thereby positioning the control knob rotationally. Similarly, axial travel of the shaft is limited by the shaft abutting against the stop rib thereby positioning the shaft axially. However, upon an sudden axial force against the knob, the stop rib will collapse and the knob will move axially inward along the shaft.

The arcuate portion of the D-shaped aperture is formed by a living hinge portion with outwardly facing stop bumps and an outwardly concentric relatively fixed wall. This arcuate portion, along with the elastic nature of the molded plastic, provides for torsional elasticity when the control knob is turned and for the return of the control knob to the "home position" after the rotational force is removed from the knob. Additionally, the structure of the living hinge applies the spring force required for holding the control knob on the metal shaft while also allowing some flexing during applied torque rotation. The outwardly facing stop bumps allow the living hinge to flex to a certain point during applied torque, but will then bottom out on the outwardly concentric relatively fixed wall thereby limiting full rotation of the knob on the shaft.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
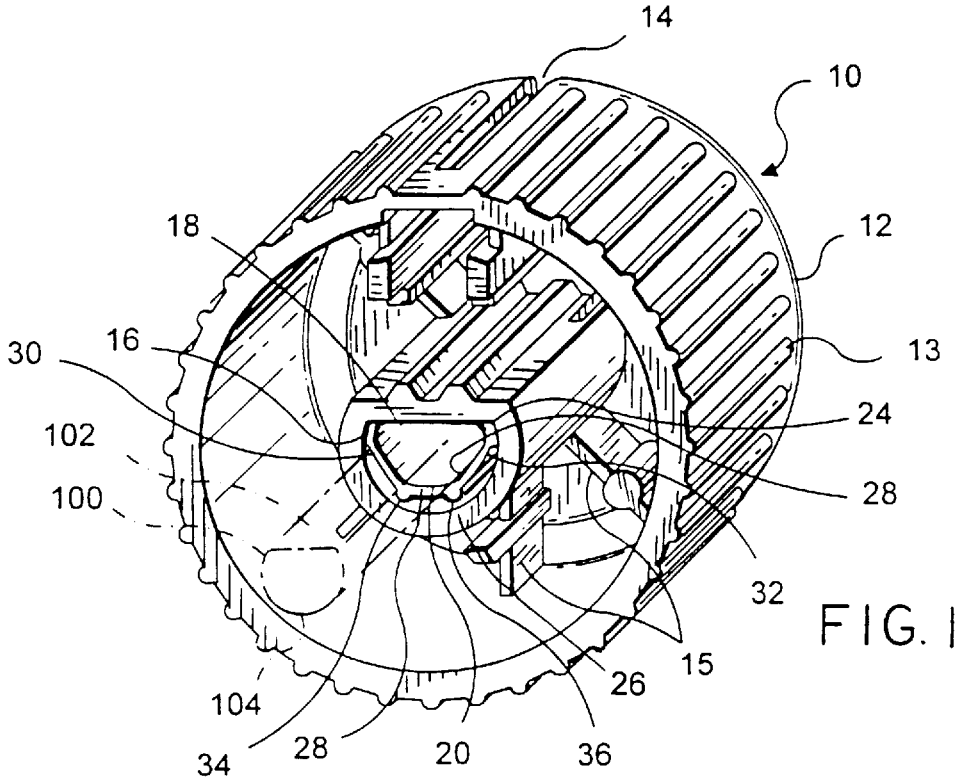
FIG. 1 is a rear perspective view of the control knob of the present invention with a shaft inserted.

Referring now to the drawings in detail wherein like numerals refer to like elements throughout the several views, one sees that FIG. 1 is a rear perspective view of the control knob 10 of the present invention with a metallic shaft 100 inserted therein. Shaft 100 has a cross section with a planar portion 102 and an arcuate portion 104. Arcuate portion 104 typically spans much more than 180° of the circumference of shaft 100, and typically spans about 270°.

Control knob 10 is typically a one-piece integral structure formed of molded plastic. Control knob 10 is formed of cylindrical shell 12 with a front face 14. The outer portion of cylindrical shell 12 includes undulations 13 to provide for a firm grip for the user. Radial ribs 15 on the inner or rear portion of front face 14 support the structure of control knob 10. Slot 17 is formed at a upper "twelve o'clock" position in front face 14. While the inner or rear portion of front face 14 is shown in the drawings, the exterior or exposed portion of front face 14 of the control knob 10 is not shown in the drawings, but includes the typical decorative and utilitarian features as are required for the specific application, such as, but not limited to, an automobile passenger compartment.

Figure 2:
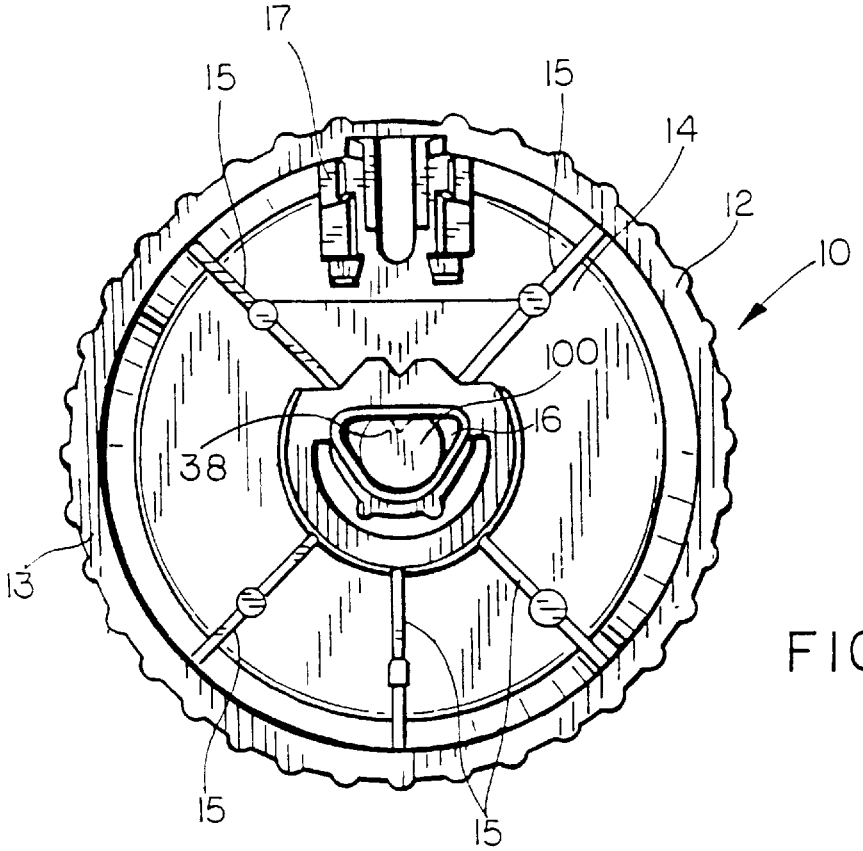
FIG. 2 is a rear plan view of the control knob of the present invention with a shaft inserted, the stop rib being shown in phantom.

As shown in FIGS. 1 and 2, aperture 16 is in a central axial location of control knob 10 and is formed by a relatively rigid planar portion 18 and an arcuate portion 20 thereby forming a D-shaped cross section. Planar portion 18 includes ends 22, 24. Arcuate portion 20 includes a relatively rigid outer concentric arcuate portion 26 and a relatively flexible inner concentric arcuate portion 28. Relatively rigid outer concentric arcuate portion 26 is integrally formed with ends 22, 24 of planar portion 18. Relatively flexible inner concentric arcuate portion 28 is attached to ends 22, 24 of planar portion 18 by living hinges 30, 32, respectively.

The relatively flexible inner concentric arcuate portion 28 along with living hinges 30, 32 provides the spring force required to hold the control knob 10 onto shaft 100.

Figure 3:
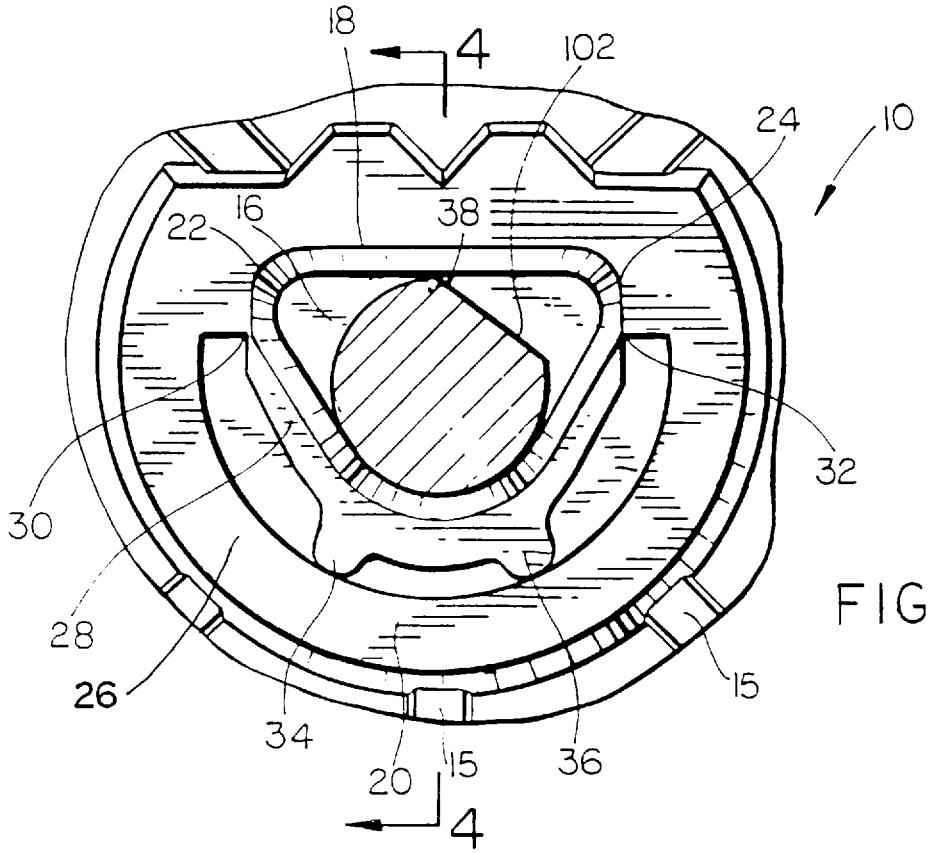
FIG. 3 is a rear plan view of the central area of the control knob wherein sufficient rotation torque is applied to cause the stop bumps to engage the relatively rigid outer concentric arcuate portion thereby reducing additional torsional elasticity of the control knob with respect to the shaft and limiting full rotation of the knob on the shaft.

Relatively flexible inner concentric arcuate portion 26 further includes outwardly oriented stop bumps 34, 36. The gap between stop bumps 34, 36 and relatively rigid outer concentric arcuate portion 26 allows for a limited amount of torsional elasticity and rotation of the control knob 10 with respect to the shaft 100, but, as shown in FIG. 3, at an amount of torque exceeding a threshold, the planar portion 102 of shaft 100 becomes unaligned with the planar portion 18 of aperture 16 and relatively flexible inner concentric arcuate portion 28 is urged outwardly so that stop bumps 34, 36 are pushed against relatively rigid outer concentric arcuate portion 26 thereby reducing additional torsional elasticity and limiting further rotation of the control knob 10 with respect to the shaft 100. This threshold, of course, is determined by the dimensions and material characteristics (such as the modulus of elasticity) of the control knob 10.

Figure 4:
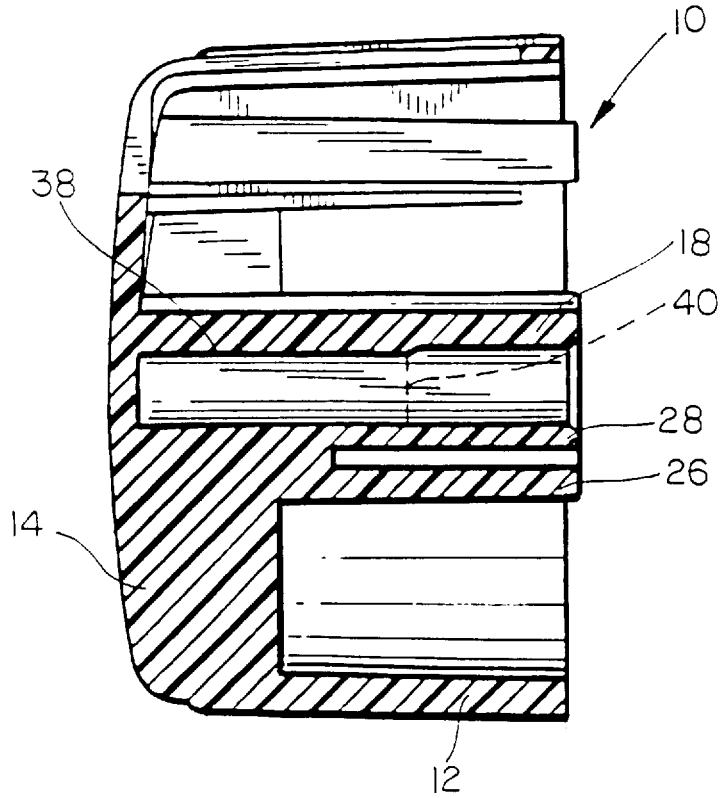
FIG. 4 is a side cross-sectional view of the control knob of the present invention, particularly showing the stop rib.

As shown in FIGS. 2 and 4, relatively rigid planar portion 18 includes axially oriented stop rib 38 of a V-shaped cross section extending generally from front face 14 through a partial length of planar portion 18. Stop rib 38 allows the shaft 100 to be axially inserted into aperture 16 only to the extent of phantom line 40 of FIG. 4. That is, shaft 100 can not be inserted past stop rib 38. However, if a sudden impact pushes control knob 10 rearwardly into shaft 100, the stop rib 38, being formed of molded plastic, collapses and the control knob 10 moves axially inward along shaft 100.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A control knob including an integral structure for engaging a shaft, the structure including:

a planar portion with first and second ends; and an arcuate portion joining said first and second ends of said planar portion, said arcuate portion further including a relatively rigid outer arcuate portion and a relatively flexible inner arcuate portion, said relatively flexible inner arcuate portion including at least one outwardly pointing protrusion, a gap being defined between said at least one outwardly pointing protrusion and said relatively rigid outer arcuate portion.

2. The control knob of claim 1 wherein said relatively flexible inner arcuate portion is joined to said first and second ends of said planar portion by living hinge means.

3. The control knob of claim 2 wherein said at least one outwardly pointing protrusion is spaced from said relatively rigid outer arcuate portion when the control knob is free of torque with respect to the shaft, and wherein said at least one outwardly pointing protrusion is engaged against said relatively rigid outer arcuate portion by applying torque exceeding a predetermined torque to the control knob with respect to the shaft.

4. The control knob of claim 3 wherein said planar portion of said structure is engageable with a planar circumferential section of said shaft and said arcuate portion of said structure is engageable with a cylindrical circumferential section of said shaft, and wherein when torque is applied exceeding said predetermined torque, said planar portion of said structure becomes unaligned with said planar circumferential section of the shaft thereby urging said at least one outwardly pointing protrusion against said relatively rigid outer arcuate portion.

5. The control knob of claim 4 wherein said planar portion includes an axial stop means extending along a portion thereof for limiting insertion of the shaft into said structure.

6. The control knob of claim 5 wherein said axial stop means collapses under sudden force upon the control knob allowing additional insertion of the shaft into said structure.

7. The control knob of claim 6 wherein the control knob is formed of an integral piece of molded plastic.

8. A control knob with a structure for engaging a shaft, the structure including an aperture of cross section complementary to the shaft, said aperture including a stop rib extending along a longitudinal portion thereof thereby limiting insertion of the shaft into said aperture, said stop rib being elastic so as to collapse upon a sudden impact, thereby allowing the shaft to become additionally inserted into said aperture.

* * * * *